US011592762B1

(12) United States Patent
Umenai

(10) Patent No.: US 11,592,762 B1
(45) Date of Patent: Feb. 28, 2023

(54) IMAGE FORMING APPARATUS WITH CHANGE ROLLER AND FLYWHEEL

(71) Applicant: FUJIFILM Business Innovation Corp., Tokyo (JP)

(72) Inventor: Ko Umenai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/546,607

(22) Filed: Dec. 9, 2021

(30) Foreign Application Priority Data

Aug. 25, 2021 (JP) ..... JP2021-137627

(51) Int. Cl.

| | |
|---|---|
| ***G03G 15/16*** | (2006.01) |
| ***G03G 15/08*** | (2006.01) |
| ***G03G 21/16*** | (2006.01) |
| *G03G 15/00* | (2006.01) |

(52) U.S. Cl.
CPC ..... *G03G 15/0822* (2013.01); *G03G 15/1605* (2013.01); *G03G 15/1615* (2013.01); *G03G 21/1647* (2013.01); *G03G 15/757* (2013.01)

(58) Field of Classification Search
CPC ..... G03G 15/0822; G03G 15/1605; G03G 15/1615; G03G 15/168; G03G 15/757; G03G 21/1647
See application file for complete search history.

(56) References Cited

U.S. PATENT DOCUMENTS

2015/0346648 A1* 12/2015 Kudo ..... G03G 15/1615 399/121
2017/0060043 A1* 3/2017 Kitago ..... G03G 15/1615
2020/0110352 A1* 4/2020 Shimamoto ..... G03G 15/1615

FOREIGN PATENT DOCUMENTS

JP 2007-264292 A 10/2007

* cited by examiner

*Primary Examiner* — Sophia S Chen
(74) *Attorney, Agent, or Firm* — Oliff PLC

(57) ABSTRACT

An image forming apparatus includes: an image carrier body to be transported; an image forming unit that forms an image on the image carrier body; a change roller that is in contact with an inner peripheral surface of the image carrier body so as to be rotatable around a rotation axis and that is capable of changing an angle of the rotation axis with respect to a width direction of the image carrier body; a flywheel provided at the change roller; and a driving mechanism that applies a driving force for changing an angle of the rotation axis with respect to the width direction to an applied portion that moves together with the change roller. A direction of the driving force applied to the applied portion by the driving mechanism is opposite to a direction in which the applied portion moves due to gravity acting on the flywheel.

9 Claims, 10 Drawing Sheets

IMAGE FORMING APPARATUS WITH CHANGE ROLLER AND FLYWHEEL

CROSS-REFERENCE TO RELATED APPLICATIONS

This application is based on and claims priority under 35 USC 119 from Japanese Patent Application No. 2021-137627 filed Aug. 25, 2021.

BACKGROUND

(i) Technical Field

The present disclosure relates to an image forming apparatus.

(ii) Related Art

An image forming apparatus of Japanese Unexamined Patent Application Publication No. 2007-264292 is an electrophotographic image forming apparatus including an image carrier; a latent image forming device that forms a latent image on the image carrier; a developing device that develops the latent image into a visible image; an endless intermediate image carrying belt that runs while being partially close to the image carrier; a first transfer device that transfers the developed visible image on the image carrier to the intermediate image carrying belt; a recording body transport device that transports a recording body; a second transfer device that transfers the image on the intermediate image carrying belt onto the recording body; and a fixing device that fixes the image to the recording body. The intermediate image carrying belt is stretched between a driving roller and a driven roller, and a rotational inertia controller is coupled to a rotation shaft of the driven roller.

SUMMARY

Aspects of non-limiting embodiments of the present disclosure relate to reducing a driving force required to be generated by a driving mechanism in order to rock a rocking roller provided with a flywheel, as compared with a case where a direction of a driving force to be applied to an applied portion by a driving mechanism is the same as a direction in which the applied portion moves due to gravity acting on the flywheel.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image carrier body to be transported; an image forming unit that forms an image on the image carrier body; a change roller that is in contact with an inner peripheral surface of the image carrier body so as to be rotatable around a rotation axis and that is capable of changing an angle of the rotation axis with respect to a width direction of the image carrier body; a flywheel provided at the change roller; and a driving mechanism that applies a driving force for changing an angle of the rotation axis with respect to the width direction to an applied portion that moves together with the change roller, wherein a direction of the driving force applied to the applied portion by the driving mechanism is opposite to a direction in which the applied portion moves due to gravity acting on the flywheel.

BRIEF DESCRIPTION OF THE DRAWINGS

An exemplary embodiment of the present disclosure will be described in detail based on the following figures, wherein.

DETAILED DESCRIPTION

Hereinafter, an exemplary embodiment according to the disclosure will be described in detail with reference to the drawings. Hereinafter, an upstream side in a transport direction of recording paper P as an example of a recording medium may be simply referred to as an "upstream side", and a downstream side in the transport direction may be simply referred to as a "downstream side". Similarly, an upstream side in a circling direction of a transfer belt (belt) (image carrier body) 52 may be simply referred to as an "upstream side", and a downstream side in the circling direction (transport direction) may be simply referred to as a "downstream side". In the following description, a reference position of the "upstream side" and the "downstream side" of the transfer belt is a second transfer position T2 (nip region Np) illustrated in FIG. 4. That is, a direction from the second transfer position T2 toward a pressing roller 49 after passing through a driving roller 44 is the "downstream side" of the transfer belt, and a direction from the second transfer position T2 toward a second photoreceptor unit 30K after passing through a driven roller 47 is the "upstream side" of the transfer belt.

Figure 1:
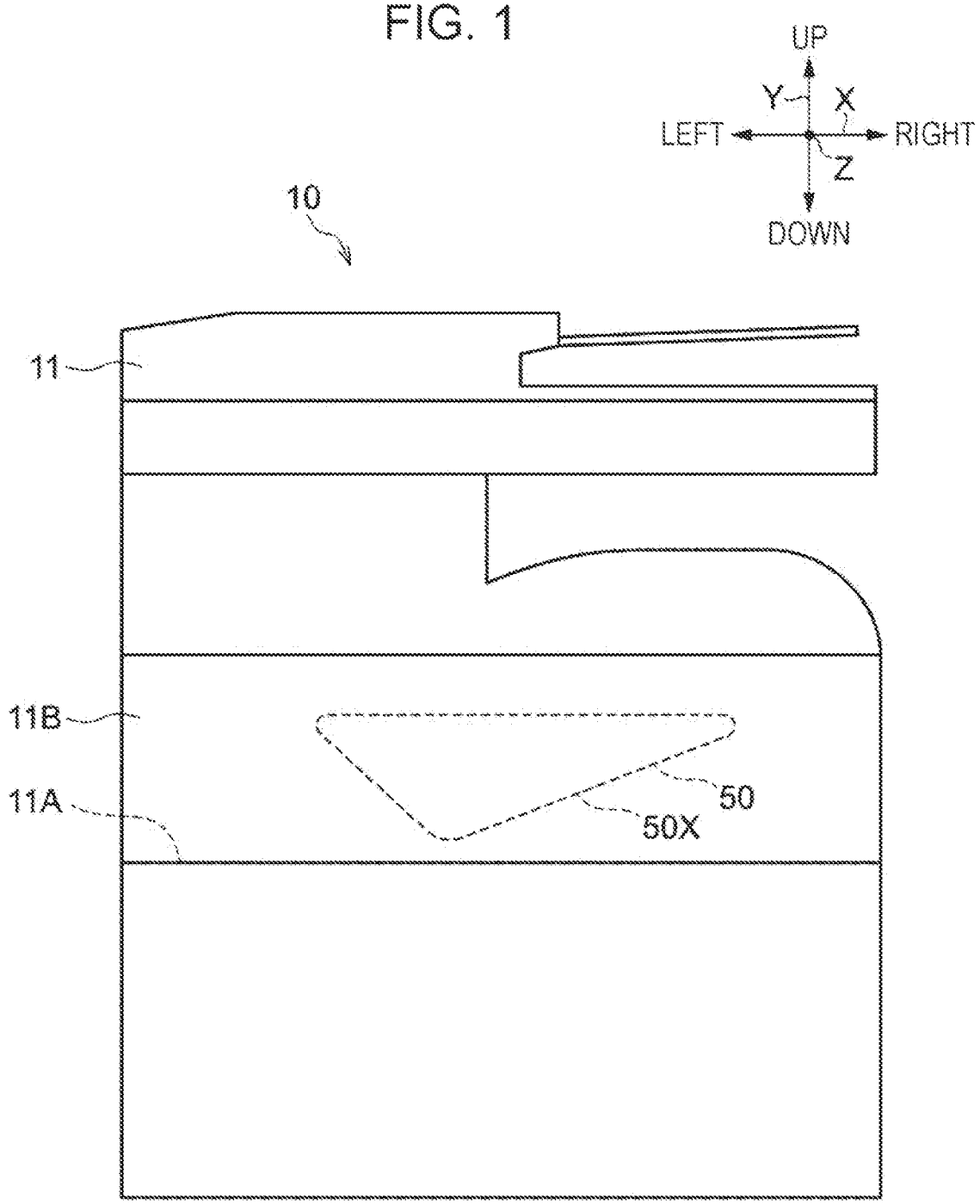
FIG. 1 is a front view of an image forming apparatus according to a present exemplary embodiment.
Figure 4:
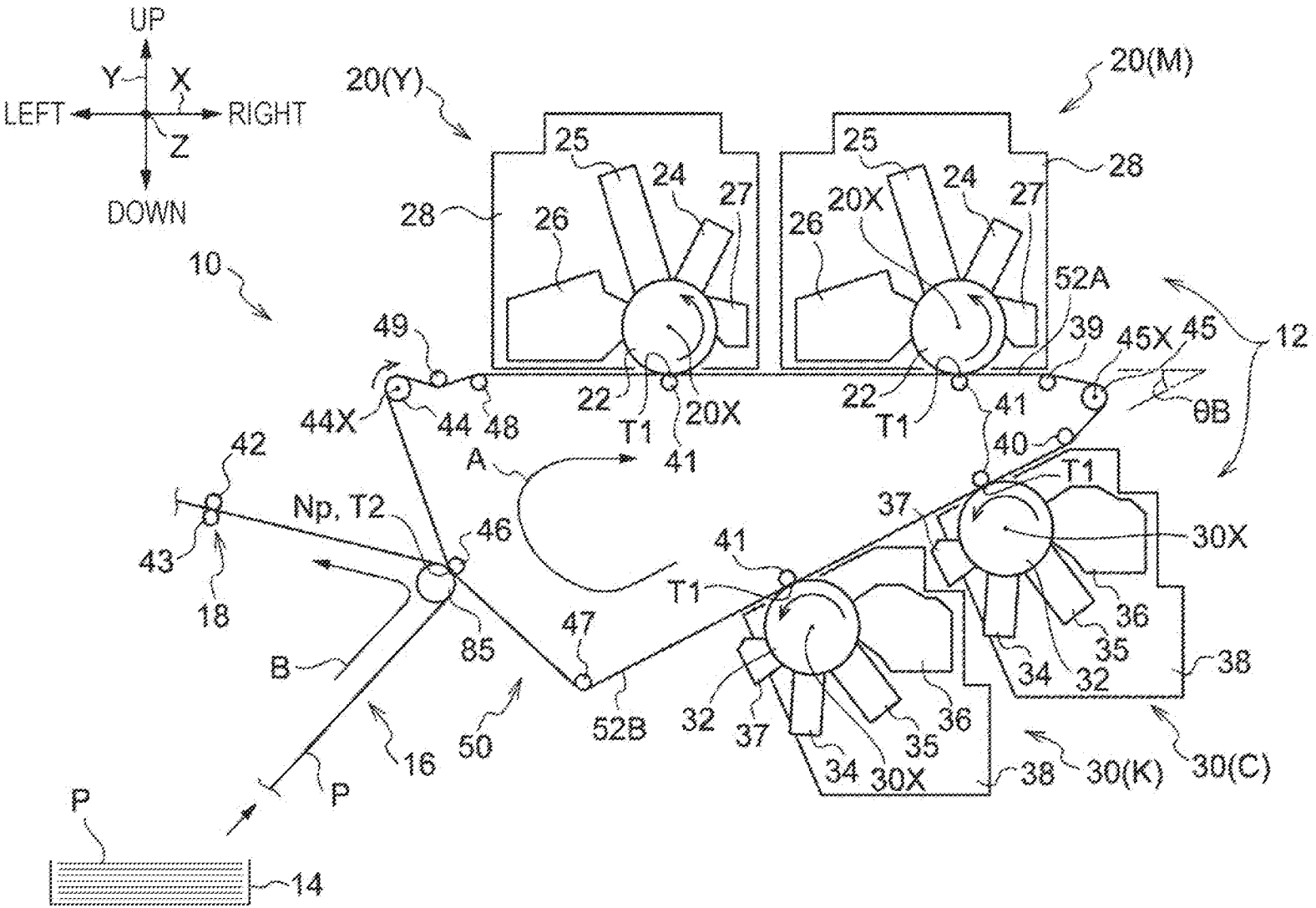
FIG. 4 is a schematic side view illustrating a transfer belt, a first photoreceptor drum, a second photoreceptor drum, a first transfer roller, a storage section, and a fixing device according to the exemplary embodiment.

As illustrated in FIGS. 1 and 4, an image forming apparatus 10 according to the present exemplary embodiment is of an electrophotographic system that forms a toner image (an example of an image) on recording paper P. The image forming apparatus 10 includes a housing 11, an image forming section 12, a storage section 14, a transport section 16, and a fixing device 18. Hereinafter, each component of the image forming apparatus 10 will be described.

In the following description, a width direction (horizontal direction) of the housing 11 is defined as an X direction, an up-down direction (vertical direction) of the housing 11 is defined as a Y direction, and a front-rear direction (a direction orthogonal to a paper surface of FIG. 1) orthogonal to the X direction and the Y direction is defined as a Z direction. In FIG. 1, the near side of the paper surface is a front side, and the far side of the paper surface is a rear side.

Housing

As illustrated in FIG. 1, an opening 11A is formed in a front surface of the housing 11 having a substantially rectangular-parallelepiped shape. The housing 11 includes an opening/closing member 11B that may open and close the opening 11A. The image forming section 12, the storage section 14, the transport section 16, and the fixing device 18 are provided in an internal space of the housing 11. A first photoreceptor unit 20, a second photoreceptor unit 30, and a transfer device 50 (integrated object 50X) described later are movable between the internal space of the housing 11 and a space in front of the housing 11 through the opening 11A.

Image Forming Section

The image forming section 12 has a function of forming a toner image on recording paper P. The image forming section 12 includes the first photoreceptor unit 20, the second photoreceptor unit 30, and the transfer device 50.

Photoreceptor Units

As illustrated in FIG. 4, two first photoreceptor units 20 and two second photoreceptor units 30 are provided. Each first photoreceptor unit 20 and each second photoreceptor unit 30 are attachable to and detachable from an apparatus body. The image forming apparatus 10 includes first photoreceptor units 20Y and 20M for yellow (Y) and magenta (M) and second photoreceptor units 30C and 30K for cyan (C) and black (K).

In the following description, in a case where it is necessary to distinguish each color of yellow (Y), magenta (M), cyan (C), or black (K), an alphabet of Y, M, C, or K is added after a reference numeral of each member. In a case where it is not necessary to distinguish each color, an alphabet of Y, M, C, or K may be omitted.

The transfer belt 52 made of an elastic material of the transfer device 50 described later includes two straight portions that are straight-line shaped when viewed in the Z direction. The two straight portions are an upper portion 52A and a lower portion 52B. When viewed in the Z direction, the upper portion 52A extends in the X direction, and the lower portion 52B is inclined with respect to the X direction. That is, when viewed in the Z direction, an angle θB (see FIG. 4) defined by the lower portion 52B and the X direction is an acute angle, and the angle θB is larger than an upper portion angle defined by the upper portion 52A and the X direction. Note that the upper portion angle is 0° or an acute angle slightly larger than 0°. When viewed in the Z direction, the upper portion 52A and the lower portion 52B are mutually arranged in the Y direction. A width direction of the transfer belt 52 extends in the Z direction.

The two first photoreceptor units 20 face an outer peripheral surface (upper surface) of the upper portion 52A and are arranged in the X direction along the upper portion 52A. Each first photoreceptor unit 20 includes a first photoreceptor drum 22 that rotates in one direction (for example, the counterclockwise direction in FIG. 4). Each first photoreceptor drum 22 is rotatable around a rotation axis 20X extending in the Z direction. Each first photoreceptor unit 20 includes a first charging portion 24, a first exposure portion 25, a first developing portion 26, and a first removing portion 27 in this order from the upstream side in the rotation direction of the first photoreceptor drum 22. Each first photoreceptor unit 20 further includes a pair of support plates 28 separated from each other in the Z direction. One of the support plates 28 is not illustrated in FIG. 4. The first charging portion 24, the first exposure portion 25, the first developing portion 26, and the first removing portion 27 are members extending in the Z direction. Both end portions of the first charging portion 24, the first exposure portion 25, the first developing portion 26, and the first removing portion 27 in the Z direction are supported by the pair of support plates 28. Further, relative movement of the pair of support plates 28 is restricted.

The two second photoreceptor units 30 face an outer peripheral surface (lower surface) of the lower portion 52B and are arranged along the lower portion 52B. Each second photoreceptor unit 30 includes a second photoreceptor drum 32 that rotates in one direction (for example, the counterclockwise direction in FIG. 4). Each second photoreceptor drum 32 is rotatable around a rotation axis 30X extending in the Z direction. Each second photoreceptor unit 30 includes a second charging portion 34, a second exposure portion 35, a second developing portion 36, and a second removing portion 37 in this order from the upstream side in the rotation direction of the second photoreceptor drum 32. Each second photoreceptor unit 30 further includes a pair of second support plates 38 separated from each other in the Z direction. One of the second support plates 38 is not illustrated in FIG. 4. The second charging portion 34, the second exposure portion 35, the second developing portion 36, and the second removing portion 37 are members extending in the Z direction. Both end portions of the second charging portion 34, the second exposure portion 35, the second developing portion 36, and the second removing portion 37 in the Z direction are supported by the pair of second support plates 38. Further, relative movement of the pair of second support plates 38 is restricted.

In the present specification and claims, a term "image forming unit" refers to a unit that causes toner or ink to adhere to an image carrier body (for example, the transfer belt 52). That is, the first photoreceptor drum 22 of the first photoreceptor unit 20 corresponds to the "image forming unit", and the second photoreceptor drum 32 of the second photoreceptor unit 30 corresponds to the "image forming unit". That is, the first charging portion 24, the first exposure portion 25, the first developing portion 26, and the first removing portion 27 do not correspond to the "image forming unit". Similarly, the second charging portion 34, the second exposure portion 35, the second developing portion 36, and the second removing portion 37 do not correspond to the "image forming unit". As will be described later, when the image forming apparatus 10 is of an inkjet system, an inkjet head corresponds to the "image forming unit".

The first charging portion 24 of each first photoreceptor unit 20 charges an outer peripheral surface of the first photoreceptor drum 22. Then, the first exposure portion 25 exposes the outer peripheral surface of the first photoreceptor drum 22 charged by the first charging portion 24 to light to form an electrostatic latent image on the outer peripheral surface of the first photoreceptor drum 22. The first developing portion 26 develops the electrostatic latent image formed on the outer peripheral surface of the first photoreceptor drum 22 by the first exposure portion 25 to form a toner image. After the toner image is transferred to the transfer belt 52, the first removing portion 27 removes the toner remaining on the outer peripheral surface of the first photoreceptor drum 22.

The second charging portion 34 of each second photoreceptor unit 30 charges an outer peripheral surface of the second photoreceptor drum 32. Then, the second exposure portion 35 exposes the outer peripheral surface of the second photoreceptor drum 32 charged by the second charging portion 34 to light to form an electrostatic latent image on the outer peripheral surface of the second photoreceptor drum 32. The second developing portion 36 develops the electrostatic latent image formed on the outer peripheral surface of the second photoreceptor drum 32 by the second exposure portion 35 to form a toner image. After the toner image is transferred to the transfer belt 52, the second removing portion 37 removes the toner remaining on the outer peripheral surface of the second photoreceptor drum 32.

Transfer Device

Figure 2:
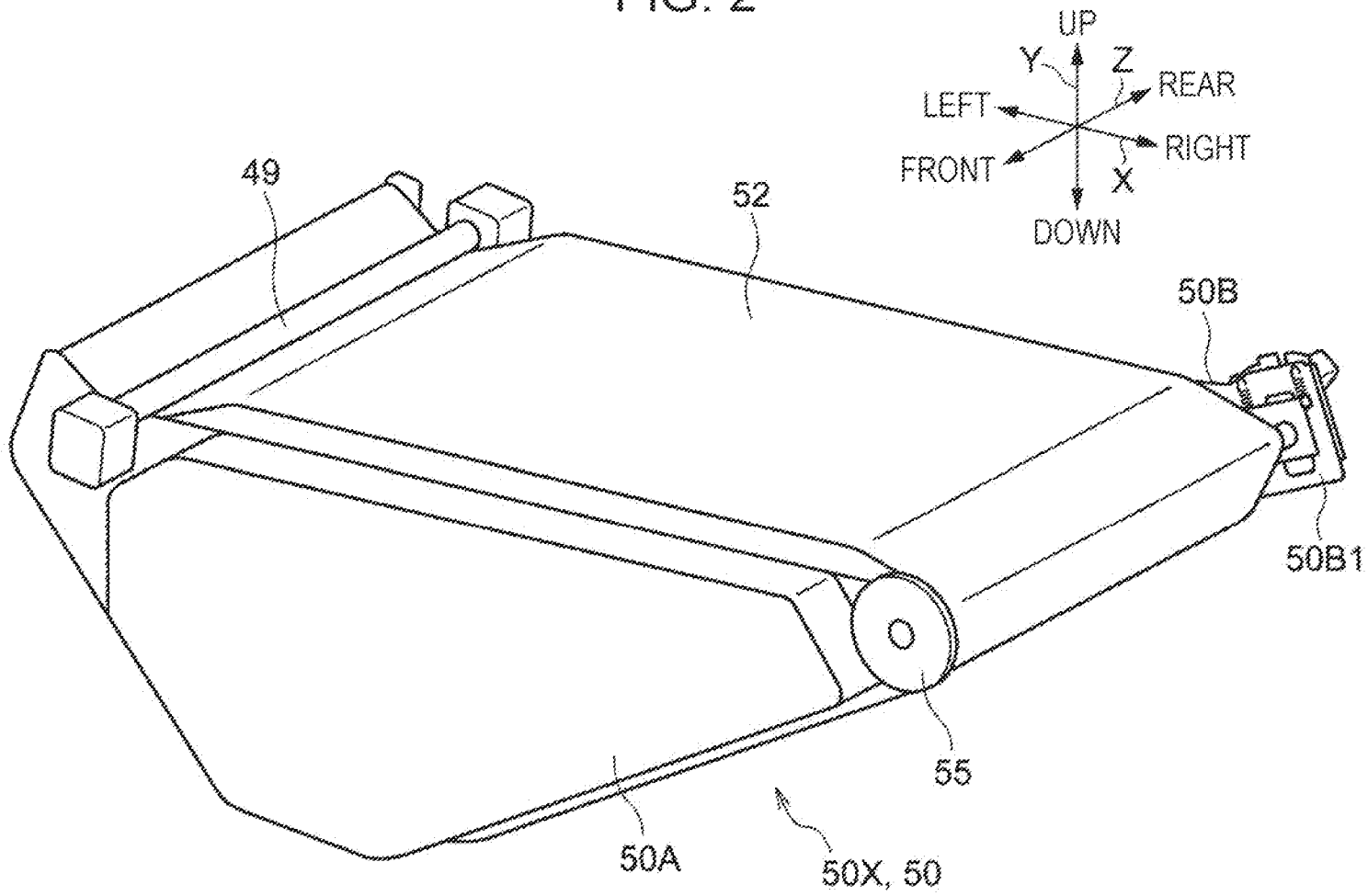
FIG. 2 is a perspective view of an integrated object constituting a part of a transfer device according to the exemplary embodiment, as viewed from the front.
Figure 3:
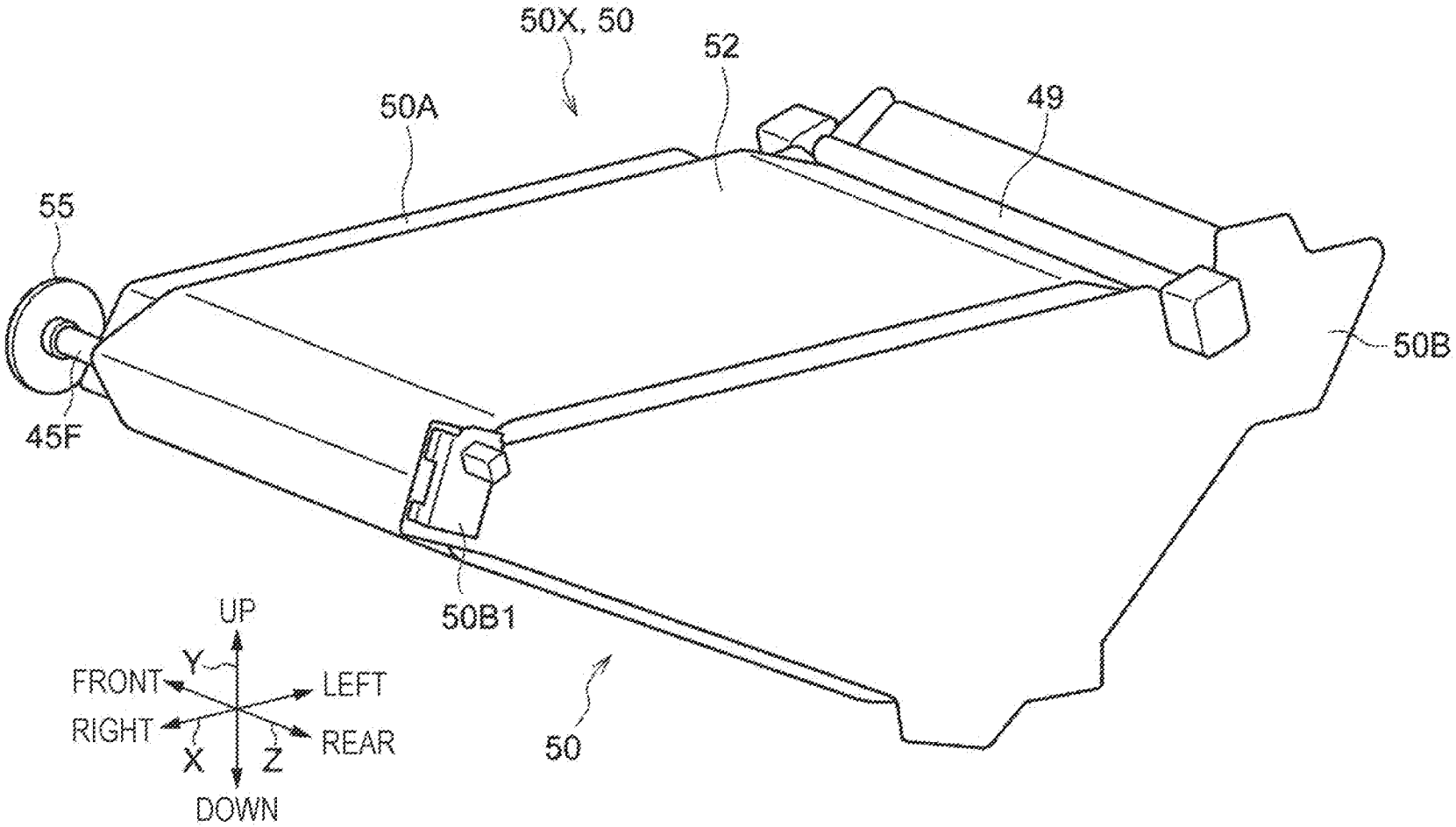
FIG. 3 is a perspective view of the integrated object according to the exemplary embodiment, as viewed from the rear.

As illustrated in FIGS. 2 to 4, the transfer device 50 includes a front base member 50A, a rear base member 50B, four first transfer rollers 41 serving as first transfer bodies, a driving roller 44, a steering roller (change roller) 45, a backup roller 46, the transfer belt 52 serving as a transfer body, a flywheel 55, a driven mechanism 60 (see FIG. 6), a driving mechanism 70 (see FIG. 6), and a transfer cylinder 85 serving as a second transfer body. That is, the transfer device 50 first transfers the toner images formed on the outer peripheral surfaces of the respective first photoreceptor drums 22 to the transfer belt 52 in a superimposed manner, and second transfers the superimposed toner images to recording paper P.

Front Base Member, Rear Base Member

As illustrated in FIGS. 2 and 3, the transfer device 50 includes the front base member 50A and the rear base member 50B. The shapes of the front base member 50A and the rear base member 50B when viewed in the axial direction of the first photoreceptor unit 20 and the second photoreceptor unit 30 are substantially triangular. However, when viewed in the axial direction, a right end portion 50B1 of the rear base member 50B is located on the right side with respect to a right end portion of the front base member 50A. Since the front base member 50A and the rear base member 50B are coupled to each other by a coupling member (not illustrated), the front base member 50A and the rear base member 50B do not move relative to each other.

First Transfer Roller

Both end portions of each of the first transfer rollers 41 facing the upper portion 52A and each of the first transfer rollers 41 facing the lower portion 52B are rotatably supported by the front base member 50A and the rear base member 50B. As illustrated in FIG. 4, each first transfer roller 41 facing the upper portion 52A transfers the toner image formed on the outer peripheral surface of the corresponding first photoreceptor drum 22 to the outer peripheral surface of the transfer belt 52 at a first transfer position T1 between the first photoreceptor drum 22 and the first transfer roller 41. Each first transfer roller 41 facing the lower portion 52B transfers the toner image formed on the outer peripheral surface of the corresponding second photoreceptor drum 32 to the outer peripheral surface of the transfer belt 52 at a first transfer position T1 between the second photoreceptor drum 32 and the first transfer roller 41. In the present exemplary embodiment, a first transfer voltage is applied between the first transfer roller 41 and the first photoreceptor drum 22, and hence the toner image formed on the outer peripheral surface of the first photoreceptor drum 22 is transferred to the outer peripheral surface of the transfer belt 52 at the first transfer position T1. Similarly, a first transfer voltage is applied between the first transfer roller 41 and the second photoreceptor drum 32, and hence the toner image formed on the outer peripheral surface of the second photoreceptor drum 32 is transferred to the outer peripheral surface of the transfer belt 52 at the first transfer position T1.

Driven Roller

Both end portions of each of four driven rollers 39, 40, 47, and 48 are rotatably supported by the front base member 50A and the rear base member 50B. Both end portions of the driving roller 44, the backup roller 46, and the pressing roller 49 described later are rotatably supported by the front base member 50A and the rear base member 50B.

The driven roller 39 is located on the downstream side of the first photoreceptor unit 20Y and located on the upstream side of the steering roller 45. The driven roller 40 is located on the upstream side of the second photoreceptor unit 30C and located on the downstream side of the steering roller 45. The driven roller 47 is located on the downstream side of the second photoreceptor unit 30K and located on the upstream side of the backup roller 46. The driven roller 48 is located on the upstream side of the first photoreceptor unit 20Y and located on the downstream side of the driving roller 44.

Transfer Belt

The annular transfer belt 52 is wound around the four driven rollers 39, 40, 47, and 48, the driving roller 44, the steering roller 45, the backup roller 46, and the pressing roller 49, and hence the posture is determined.

The driving roller 44 having a circular cross section is configured to be rotationally driven around an axis 44X extending in the Z direction by a driver (not illustrated), and causes the transfer belt 52 to circle at a predetermined speed in a circling direction indicated by arrow A in FIG. 4.

Figure 5:
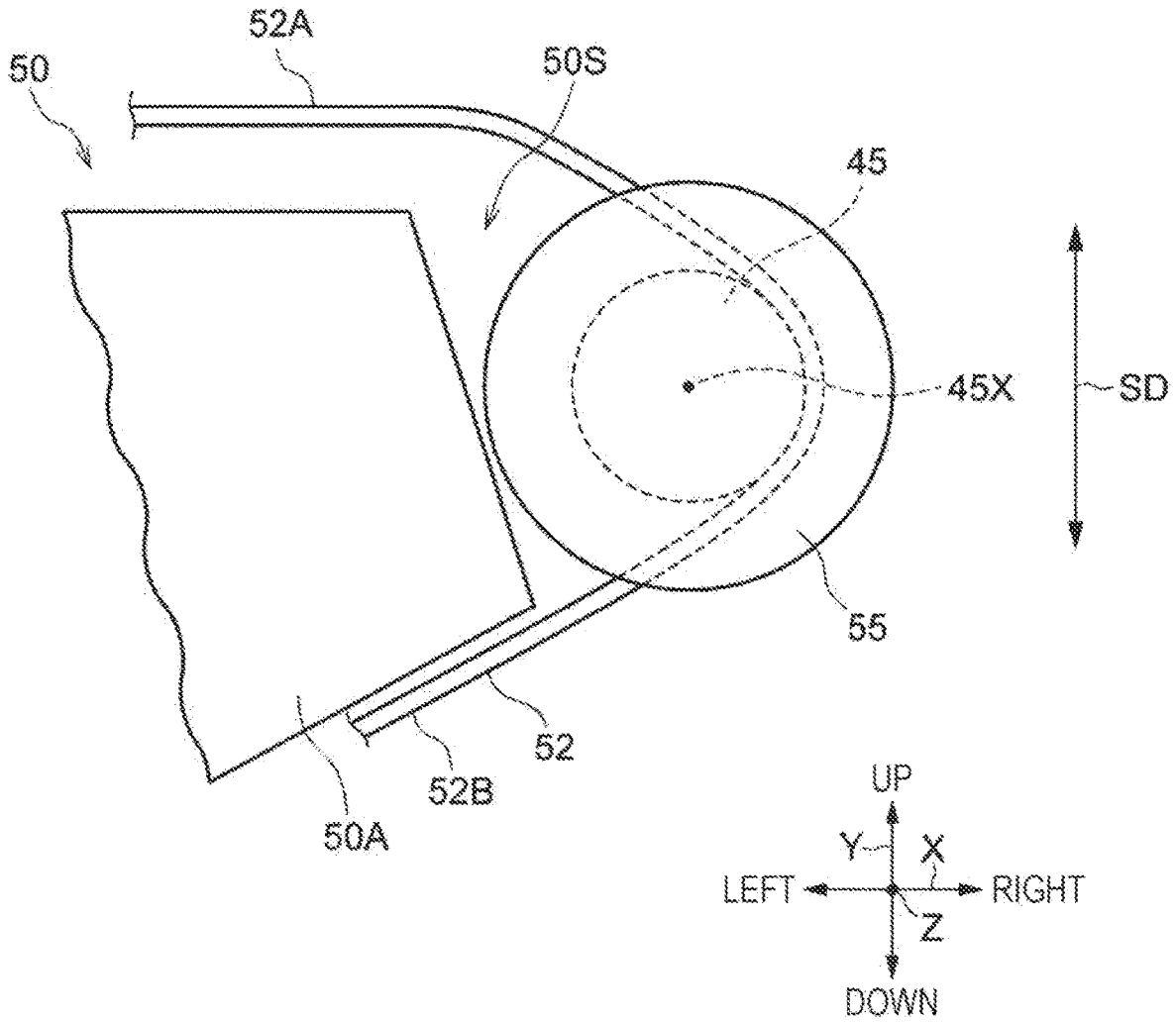
FIG. 5 is a schematic front view of a right end portion of the transfer device according to the exemplary embodiment.

The steering roller 45 having a circular cross section illustrated in FIGS. 4 and 5 is rotatable around a rotation axis 45X extending in one direction. The steering roller 45 is an example of a change roller.

Flywheel

The flywheel 55 having a disk shape is fixed to a front end portion 45F (see FIG. 3) of the steering roller 45 so as to be coaxial with the steering roller 45. The diameter of the flywheel 55 is larger than the diameter of the steering roller 45.

Driven Mechanism

Figure 6:
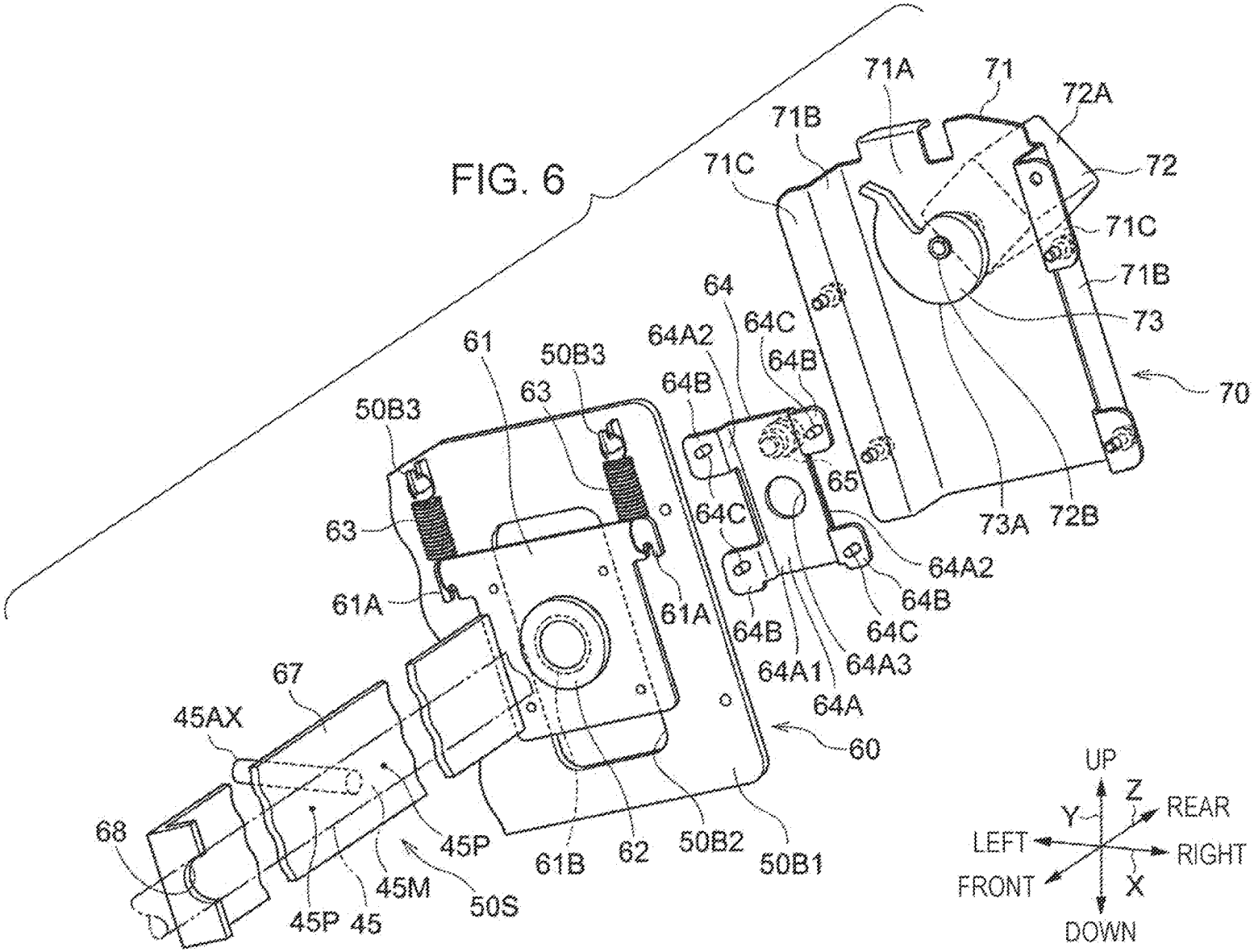
FIG. 6 is a schematic exploded perspective view of a rear base member, a driven mechanism, a tie bar, and a driving mechanism according to the exemplary embodiment, as viewed from the front.
Figure 7:
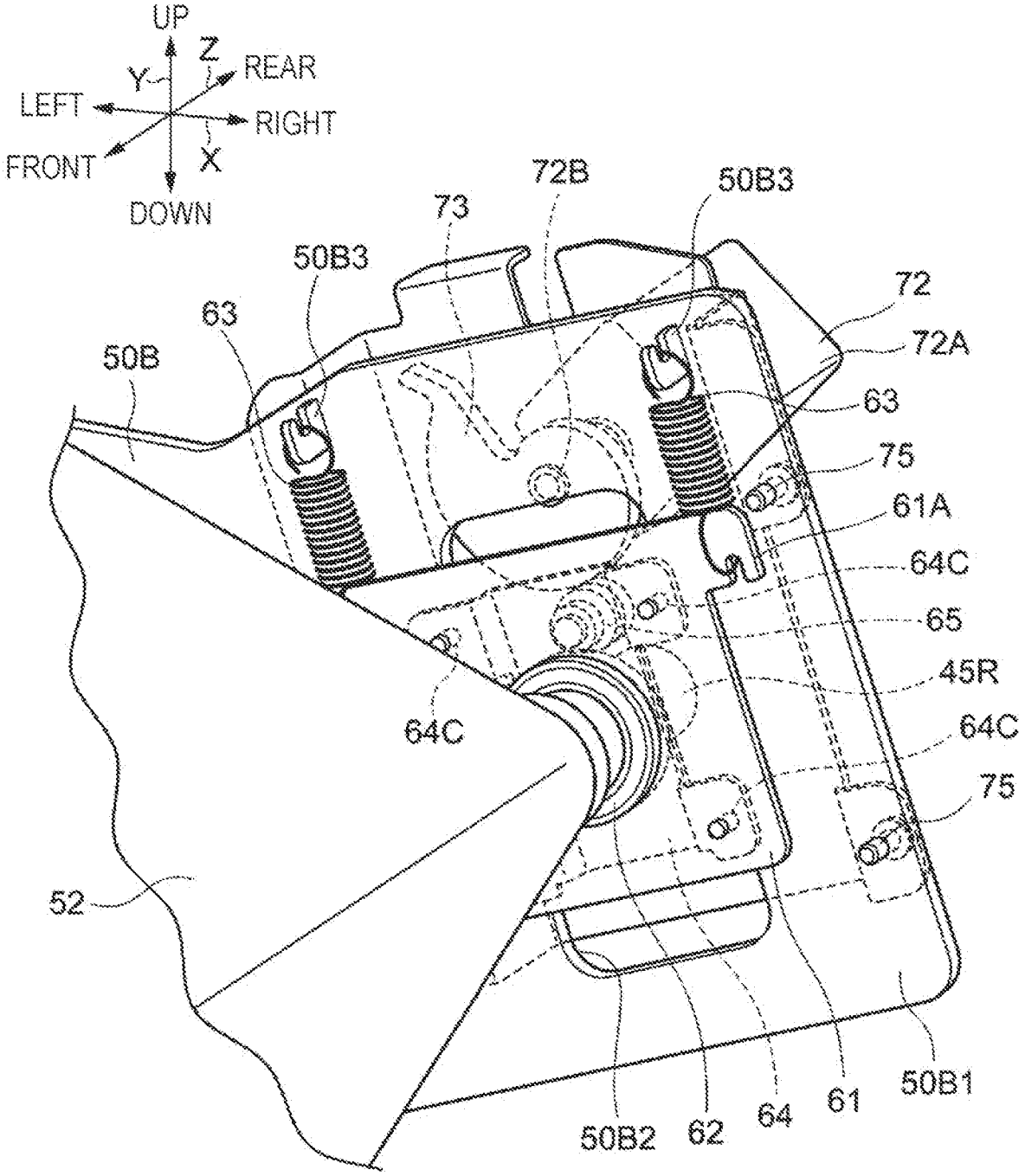
FIG. 7 is a perspective view of the transfer belt, the rear base member, the driven mechanism, and the driving mechanism according to the exemplary embodiment, as viewed from the front.
Figure 8:
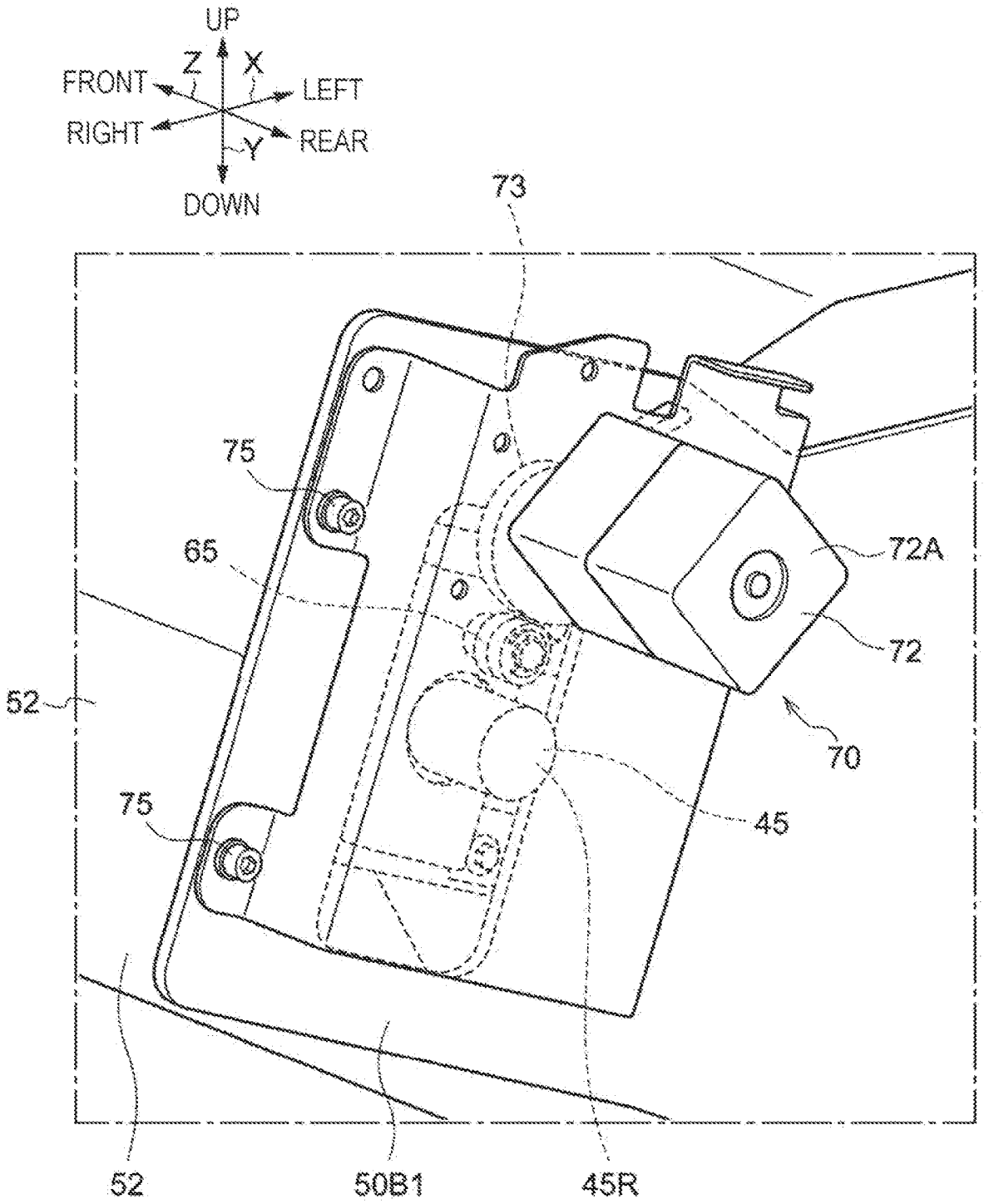
FIG. 8 is a perspective view of the transfer belt, the rear base member, the driven mechanism, and the driving mechanism according to the exemplary embodiment, as viewed from the rear.

As illustrated in FIGS. 6 to 8, the driven mechanism 60 is attached to the right end portion 50B1 of the rear base member 50B. The driven mechanism 60 includes a moving member 61, a rear bearing 62, a tension spring 63, a supported member 64, and a cam follower 65.

A quadrangular through hole 50B2 having an up-down dimension longer than a left-right dimension is formed in the right end portion 50B1. The moving member 61 is provided immediately in front of the right end portion 50B1. The up-down dimension of the moving member 61 is smaller than that of the through hole 50B2, and the left-right dimension of the moving member 61 is larger than that of the through hole 50B2. When viewed along the rotation axis 45X, a left edge portion of the moving member 61 is located on the left side with respect to the through hole 50B2, and a right edge portion of the moving member 61 is located on the right side with respect to the through hole 50B2. A pair of left and right supported portions 61A are formed on both left and right side portions of an upper end portion of the moving member 61.

Upper end portions of a pair of tension springs 63 are supported by a pair of left and right protrusions 50B3 provided at an upper portion of a front surface of the right end portion 50B1. Further, lower end portions of the respective tension springs 63 are connected to the left and right supported portions 61A of the moving member 61. When the supported portions 61A are connected to the tension springs 63, the left and right tension springs 63 are extended from the free state. That is, the left and right tension springs 63 normally generate an urging force for moving the moving member 61 upward.

A circular hole 61B is formed in a center portion of the moving member 61. The diameter of the circular hole 61B is larger than the diameter of the steering roller 45. Further, the rear bearing 62 coaxial with the circular hole 61B is rotatably supported at the circular hole 61B via a bearing (not illustrated).

The supported member 64 is provided immediately behind the right end portion 50B1. As illustrated in FIG. 6, the supported member 64 includes a base portion 64A and protruding pieces 64B provided at four positions of the base portion 64A. The base portion 64A has a substantially U-shaped cross section. The base portion 64A includes a body portion 64A1 that is substantially orthogonal to the Z direction and has a substantially quadrangular shape, and a pair of side portions 64A2 that extend forward from left and right edge portions of the body portion 64A1. A circular hole 64A3 is formed in the body portion 64A1. The diameter of the circular hole 64A3 is larger than the diameter of the steering roller 45. The up-down dimension of the supported member 64 is smaller than that of the through hole 50B2, and the left-right dimension of the supported member 64 is larger than that of the through hole 50B2. However, the left-right dimension of the body portion 64A1 is smaller than that of the through hole 50B2. When viewed along the rotation axis 45X, left edge portions of the two left protruding pieces 64B are located on the left side with respect to the through hole 50B2, and right edge portions of the two right protruding pieces 64B are located on the right side with respect to the through hole 50B2. Rear end portions of connection pins 64C extending forward from the protruding pieces 64B and penetrating through the through hole 50B2 are fixed to front surfaces of the respective protruding pieces 64B. Front end portions of the respective connection pins 64C are fixed to the moving member 61. In this manner, the moving member 61 and the supported member 64 are coupled to each other by the four connection pins 64C. Further, the two connection pins 64C on the right side face a right side surface of the through hole 50B2, and the two connection pins 64C on the left side face a left side surface of the through hole 50B2. Further, when the moving member 61 and the supported member 64 are coupled to each other, the circular hole 61B of the moving member 61, the rear bearing 62, and the circular hole 64A3 of the supported member 64 are coaxial with one another.

The cam follower 65 located above the circular hole 64A3 is rotatably supported at a rear surface of the body portion 64A1 via a rolling bearing (not illustrated). The axis of the cam follower 65 and the axis of the rolling bearing extend in the Z direction. An outer peripheral surface of the cam follower 65 is a cylindrical surface centered on the axis of the cam follower 65.

As illustrated in FIG. 6, a rear end portion of a tie bar 67 extending in the Z direction is fixed to the moving member 61. A substantially C-shaped front bearing 68 is fixed to a front end portion of the tie bar 67. Further, a rotation center shaft 45AX extending leftward from the tie bar 67 is fixed to a center portion in the longitudinal direction of the tie bar 67. The rotation center shaft 45AX is rotatably inserted into a bearing member (not illustrated) that is a component of the transfer device 50 that is not movable relative to the front base member 50A and the rear base member 50B. Hence, the tie bar 67, the moving member 61, and the front bearing 68 are rotatable relative to the bearing member around the rotation center shaft 45AX. The positions of the tie bar 67 and the moving member 61 in the left-right direction are determined by a roller (not illustrated) provided at the tie bar 67 coming into contact with a member (not illustrated) located on the left side with respect to the tie bar 67.

When the opening/closing member 11B of the housing 11 opens the opening 11A, the integrated object including the steering roller 45 and the flywheel 55 located in front of the housing 11 is moved rearward relative to the housing 11, so that the integrated object is movable to the internal space of the housing 11. At this time, the steering roller 45 is located in a right space 50S (see FIGS. 5 and 6) which is a space formed between a right end portion of the front base member 50A and a right end portion of the transfer belt 52. Further, as illustrated in FIGS. 7 and 8, a rear end portion 45R that is a portion of the steering roller 45 located in rear of a rear end surface of the transfer belt 52 when the steering roller 45 has been moved to the right space 50S is inserted into the circular hole 61B, the rear bearing 62, and the circular hole 64A3 of the supported member 64, and a front portion of the steering roller 45 is moved leftward so that the front portion of the steering roller 45 is supported by the front bearing 68. Thus, the integrated object is integrated with the moving member 61, the tie bar 67, and the front bearing 68. That is, the integrated object including the steering roller 45 and the flywheel 55 is rotatable relative to the bearing member around the rotation center shaft 45AX.

The position of the steering roller 45 in a rotation direction SD (see FIG. 5) around the rotation center shaft 45AX when the rotation axis 45X is parallel to the Z direction is a neutral position of the steering roller 45. When the flywheel 55 fixed to the steering roller 45 mounted on the rear bearing 62 and the front bearing 68 as described above is viewed along the rotation axis 45X, as illustrated in FIG. 5, a portion of an outer peripheral edge of the flywheel 55 is located on the outer peripheral side of the transfer belt 52 with respect to a right end portion of the transfer belt (the upper portion 52A and the lower portion 52B). However, as illustrated in FIGS. 2 and 3, when the integrated object including the steering roller 45 and the flywheel 55 is integrated with the moving member 61, the tie bar 67, and the front bearing 68, the front end portion 45F of the steering roller 45 (one end portion in the longitudinal direction of the steering roller 45) and the flywheel 55 are located on the front side of a front end surface of the transfer belt 52.

Further, when the steering roller 45 integrated with the moving member 61, the tie bar 67, and the front bearing 68, and the rotation center shaft 45AX are viewed in plan view, the rotation center shaft 45AX intersects with the rotation axis 45X of the steering roller 45. Further, when the steering roller 45 and the rotation center shaft 45AX are viewed in plan view, an extension line of the rotation center shaft 45AX intersects with a center portion 45M (see FIG. 6) of the steering roller 45 in the direction along the rotation axis 45X (Z direction). In this case, specific portions 45P are assumed which are two portions of the steering roller 45 located on both sides of a strict center position in the longitudinal direction of the steering roller 45. The distances from the center position to the two specific portions 45P are 10% of the total length of the steering roller 45. A region between the two specific portions 45P corresponds to "the center portion 45M of the steering roller 45 in the direction of the rotation axis 45X" in the present specification.

Driving Mechanism

As illustrated in FIGS. 6 to 8, the driving mechanism 70 is attached to a rear surface of the right end portion 50B1 of the rear base member 50B. The driving mechanism 70 includes a support member 71, an electric motor 72, and a cam member 73.

The support member 71 includes a substantially quadrangular body portion 71A, a pair of side portions 71B extending forward from both left and right edge portions of the body portion 71A, and three fixed portions 71C extending sideward from front end portions of the respective side portions 71B. A through hole (not illustrated) is formed in the body portion 71A. The support member 71 faces the rear surface of the right end portion 50B1, and the three fixed portions 71C are in contact with the rear surface of the right end portion 50B1. Further, each fixed portion 71C and the right end portion 50B1 are fixed to each other by a bolt 75 penetrating through each fixed portion 71C.

The electric motor 72 includes a case 72A and a rotation output shaft 72B protruding forward from the case 72A. The case 72A is fixed to a rear surface of the body portion 71A, and the rotation output shaft 72B penetrates forward through the through hole of the body portion 71A. Further, the cam member 73 located immediately in front of the body portion 71A is fixed to a front end portion of the rotation output shaft 72B. The electric motor 72 is controlled by a control device (not illustrated).

Figure 9:
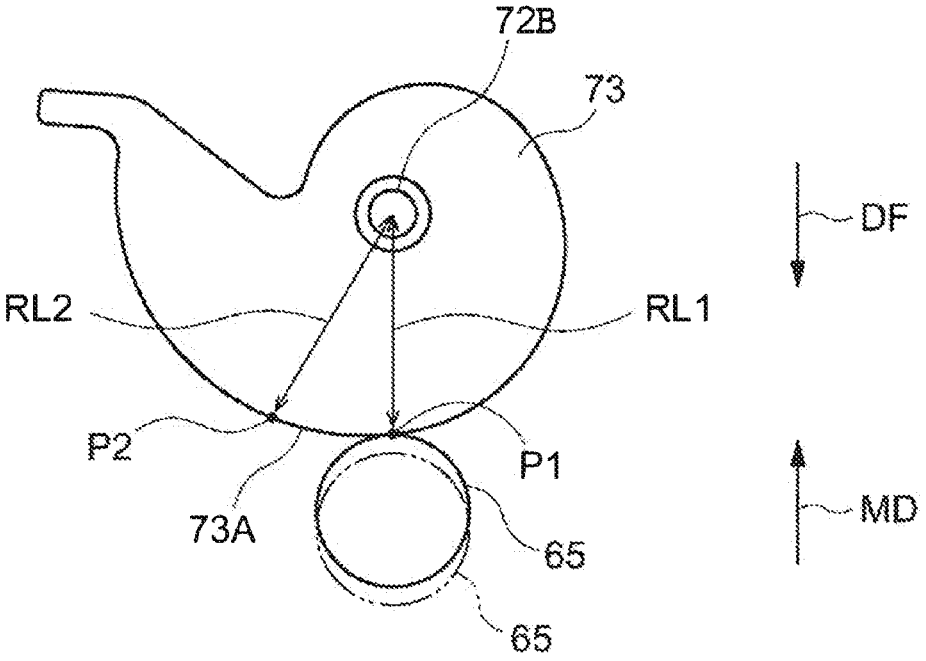
FIG. 9 is a schematic front view of a cam member and a cam follower according to the exemplary embodiment.
Figure 10:
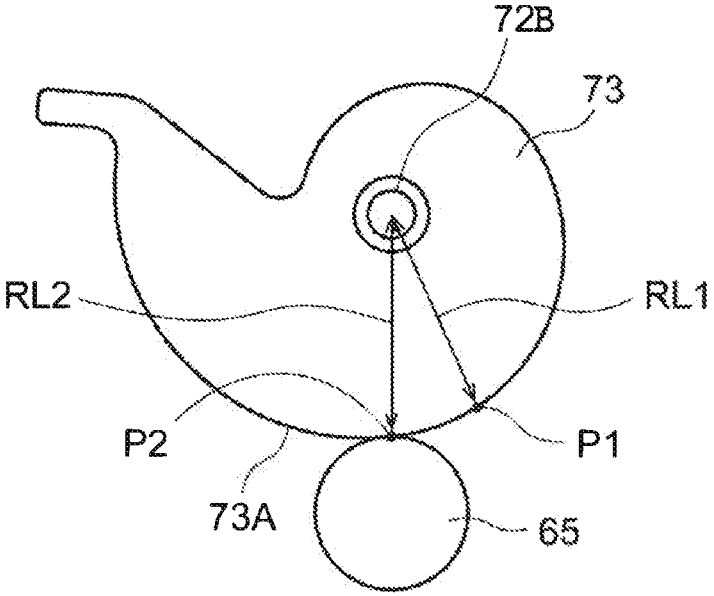
FIG. 10 is a front view similar to FIG. 9 when the cam member is rotated from the state of FIG. 9.

As illustrated in FIGS. 9 and 10, a portion of an outer peripheral surface of the cam member 73 is constituted by a cam surface 73A having different distances in the radial direction of the rotation output shaft 72B from the rotation center (rotation output shaft 72B) of the cam member 73 depending on the position in the circumferential direction. When the cam member 73 is viewed from the front along the rotation output shaft 72B, the radial distances from the rotation output shaft 72B to the cam surface 73A gradually increase as the cam surface 73A extends in the clockwise direction. For example, a radial distance RL2 between a point P2 on the cam surface 73A and the electric motor 72 is longer than a radial distance RL1 between a point P1 on the cam surface 73A and the rotation output shaft 72B.

The cam member 73 is located directly above the cam follower 65. As described above, the left and right tension springs 63 normally generate an urging force for moving the moving member 61 upward. Thus, an upper end portion of an outer peripheral surface of the cam follower 65 that moves together with the moving member 61 is normally in contact with the cam surface 73A of the cam member 73.

When the control device transmits a forward rotation signal (electric signal) to the electric motor 72 while the driven mechanism 60 and the driving mechanism 70 are in the state of FIGS. 7 to 9, the cam member 73 rotates in the counterclockwise direction around the rotation output shaft 72B in front view. Accordingly, as illustrated in FIG. 10, the contact position of the cam surface 73A with the cam follower 65 changes from the point P1 toward the point P2. Then, the cam follower 65, the supported member 64, and the moving member 61 are moved downward by the cam surface 73A against the urging force of the tension springs 63 (see an imaginary line in FIG. 9 and FIG. 10). Thus, the steering roller 45 rotates around the rotation center shaft 45AX and the flywheel 55 moves upward. Further, for example, when the point P2 is in contact with the cam follower 65, if the control device transmits a reverse rotation signal (electric signal) to the electric motor 72, the cam member 73 rotates in the clockwise direction around the rotation output shaft 72B in front view. Accordingly, the contact position of the cam surface 73A with the cam follower 65 changes from the point P2 toward the point P1. Then, the cam follower 65, the supported member 64, and the moving member 61 are moved upward by the urging force of the tension springs 63 and the cam surface 73A. Thus, the steering roller 45 rotates around the rotation center shaft 45AX and the flywheel 55 moves downward.

Some of the components of the transfer device 50 having the configuration described above are integrated with each other as described above. That is, the driven rollers 39, 40, 47, and 48, the first transfer rollers 41, the driving roller 44, the steering roller 45, the backup roller 46, the pressing roller 49, the flywheel 55, the front base member 50A, the rear base member 50B, the transfer belt 52, the driven mechanism 60, and the driving mechanism 70 are integrated with each other. Hereinafter, the integrated object of these members is referred to as an integrated object 50X. When the opening/closing member 11B of the housing 11 opens the opening 11A, by moving the integrated object 50X located inside the housing 11 forward relative to the housing 11, the integrated object 50X is movable forward of the housing 11 through the opening 11A. When the opening/closing member 11B of the housing 11 opens the opening 11A, by moving the integrated object 50X located in front of the housing 11 rearward relative to the housing 11, the integrated object 50X is movable to the internal space of the housing 11 through the opening 11A. That is, by using the opening 11A, the integrated object 50X provided in the internal space of the housing 11 is replaceable with a new integrated object 50X.

Further, when the opening/closing member 11B of the housing 11 opens the opening 11A, the steering roller 45 and the flywheel 55, which are components of the integrated object 50X provided in the internal space of the housing 11, are moved forward of the housing 11 in such an aspect as to be separated from the other components of the integrated object 50X. That is, when the front portion of the steering roller 45 is moved rightward, the support state of the front portion of the steering roller 45 by the front bearing 68 is released. Then, when the steering roller 45 and the flywheel 55 are moved forward, the rear end portion 45R exits rearward from the rear bearing 62 and the circular hole 64A3 of the supported member 64. Then, when the steering roller 45 and the flywheel 55 are further moved forward, the steering roller 45 and the flywheel 55 are moved forward of the housing 11 through the opening 11A. That is, by using the opening 11A, the steering roller 45 and the flywheel 55 provided in the internal space of the housing 11 are replaceable with a new steering roller 45 and a new flywheel 55.

As illustrated in FIG. 4, the backup roller 46 faces the transfer cylinder 85 with the transfer belt 52 interposed therebetween. A region where the transfer cylinder 85 and the transfer belt 52 are in contact with each other is the nip region Np. The nip region Np is the second transfer position T2 where the toner images are transferred from the transfer belt 52 to recording paper P.

Further, the pressing roller 49 located on the upstream side of the driven roller 48 and on the downstream side of the driving roller 44 is rotatably in contact with the outer peripheral surface of the transfer belt 52 and presses the transfer belt 52 toward the inner peripheral side.

Transport Section

As illustrated in FIG. 4, the transport section 16 includes a transport device (not illustrated) that transports recording paper P sent out from the storage section 14 in a direction of arrow B. The recording paper P sent out from the storage section 14 is transported to the transfer cylinder 85 by the transport device. The recording paper P on which a toner image has been second-transferred by passing through the transfer cylinder 85 (second transfer position T2) is transported to the fixing device 18 by the transport device.

Fixing Device

As illustrated in FIG. 4, the fixing device 18 includes a heating roller 42 as an example of a heating member and a pressing roller 43 as an example of a pressing member. The fixing device 18 fixes the toner image transferred on the recording paper P by the transfer cylinder 85 to the recording paper P by nipping the recording paper P between the heating roller 42 and the pressing roller 43 and heating and pressing the recording paper P.

Next, operations and effects of the image forming apparatus 10 configured as described above will be described in detail.

In the image forming apparatus 10 of the exemplary embodiment, when the transfer belt 52 moves (meanders) in the width direction and a movement amount detection device (not illustrated) detects a movement amount (meandering amount) of the transfer belt 52 in the width direction, the control device transmits at least one of a forward rotation signal and a reverse rotation signal to the electric motor 72. Accordingly, the steering roller 45 rotates around the rotation center shaft 45AX, and thus the angle of the rotation axis 45X with respect to the width direction (Z direction) of the transfer belt 52 changes. Consequently, meandering of the transfer belt 52 is suppressed by the steering roller 45.

As illustrated in FIGS. 9 and 10, a direction DF of a driving force applied by the electric motor 72 of the present exemplary embodiment to the cam follower 65 that moves together with the steering roller 45 via the cam member 73 is downward. In contrast, a direction MD in which the cam follower 65 (steering roller 45) moves due to gravity acting on the flywheel 55 is upward. That is, when the transfer device 50 is viewed in the Z direction, the direction DF of the driving force is opposite to the direction MD. Accordingly, the contact state between the cam follower 65 and the cam member 73 is easily maintained as compared with a case where the direction DF and the direction MD are the same. Thus, the driving force required to be generated by the electric motor 72 (driving mechanism 70) in order to change the angle of the rotation axis 45X of the steering roller 45 provided with the flywheel 55 with respect to the width direction of the transfer belt 52 may be made smaller than that in the case where the direction DF and the direction MD are the same.

The expression "opposite direction" used in this case is a concept including a case where the direction DF and the direction MD are completely parallel to each other and a case where the direction DF and the direction MD are slightly inclined to each other. In this case, the inclination angle formed by the direction DF and the direction MD is any angle of 10° or less.

Further, when the flywheel 55 of the exemplary embodiment is viewed in the Z direction, a portion of the flywheel 55 is located on the outer peripheral side of the transfer belt 52. However, the flywheel 55 may be located in front of the transfer belt 52, and the steering roller 45 may be separated from the rear bearing 62 and the front bearing 68. Thus, the steering roller 45 and the flywheel 55 may be moved forward of the housing 11 through the opening 11A provided in the front surface of the housing 11.

Further, in the image forming apparatus 10 of the exemplary embodiment, when viewed in the Z direction, a portion of the driving mechanism 70 is located on the outer peripheral side of the steering roller 45 with respect to the transfer belt 52. However, in this exemplary embodiment, the steering roller 45 and the flywheel 55 are movable relative to the driving mechanism 70 in the front-rear direction. Thus, although a portion of the driving mechanism 70 is located on the outer peripheral side of the steering roller 45 with respect to the transfer belt 52 when viewed in the Z direction, the steering roller 45 and the flywheel 55 may be moved forward of the housing 11 through the opening 11A.

Further, while the flywheel 55 is provided at the front end portion 45F of the steering roller 45, the cam follower 65 that receives the driving force generated by the electric motor 72 via the cam member 73 is located near the rear end portion of the steering roller 45. Thus, in the image forming apparatus 10 of the exemplary embodiment, the angle of the rotation axis 45X of the steering roller 45 with respect to the width direction of the transfer belt 52 may be changed more easily than a case where the flywheel 55 is provided at the front end portion 45F of the steering roller 45 and the cam follower 65 is located near the front end portion 45F of the steering roller 45 and a case where the flywheel 55 is provided at the rear end portion of the steering roller 45 and the cam follower 65 is located near the rear end portion of the steering roller 45.

The image forming apparatus 10 according to the exemplary embodiment has been described above based on the drawings. However, the image forming apparatus 10 according to the exemplary embodiment is not limited to that illustrated in the drawings, and may be appropriately changed in design without departing from the scope of the present disclosure.

Figure 11:
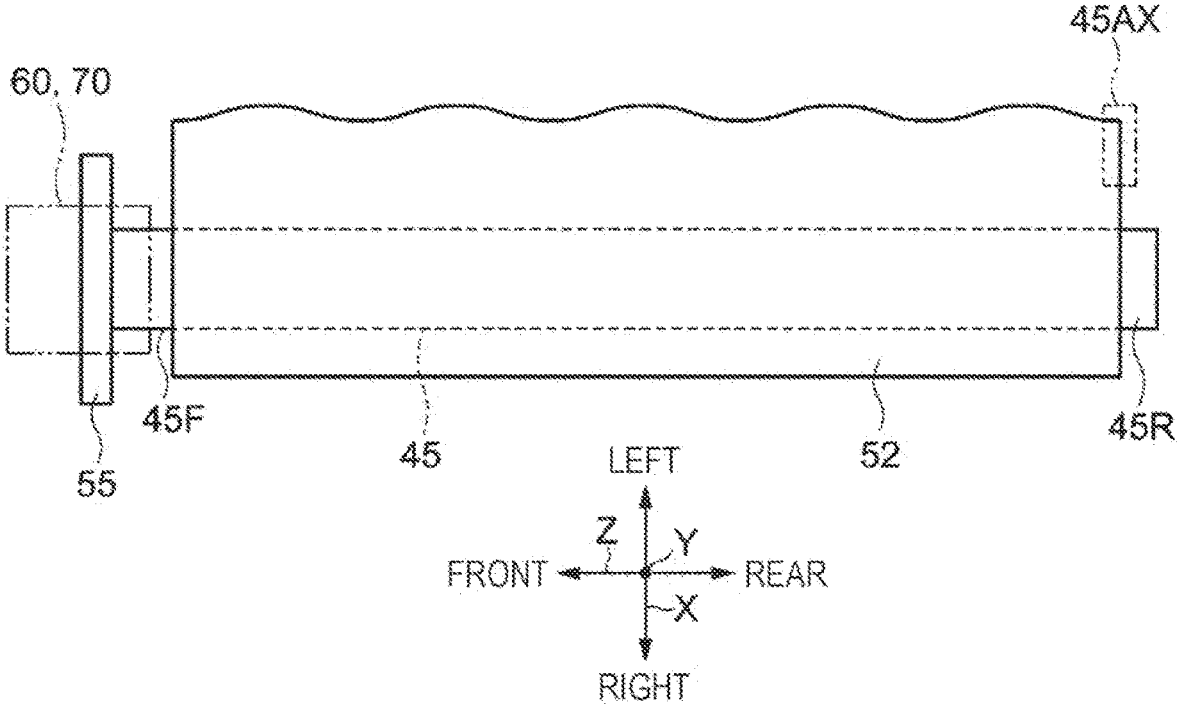
FIG. 11 is a schematic plan view of a right end portion of a transfer device according to a modification.
Figure 12:
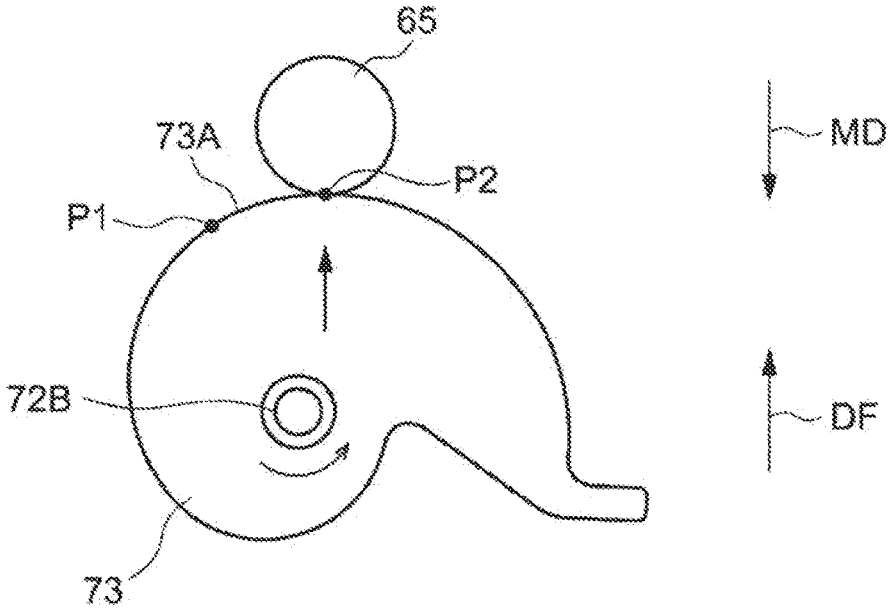
FIG. 12 is a schematic front view of a cam member and a cam follower according to a modification.

For example, the present disclosure may be implemented in an aspect of a modification illustrated in FIGS. 11 and 12. In this modification, a flywheel 55 is fixed to a front end portion 45F of a steering roller 45, and a driven mechanism 60 and a driving mechanism 70 are provided in the vicinity of a front edge portion of a transfer belt 52. Further, a rotation center shaft 45AX is provided in the vicinity of a rear end portion 45R of the steering roller 45. Accordingly, in this modification, when an electric motor 72 of the driving mechanism 70 operates, the steering roller 45 and the flywheel 55 rotate around the rotation center shaft 45AX. Further, in this modification, as illustrated in FIG. 12, a cam member 73 is located directly below a cam follower 65. Further, a direction DF of a driving force applied by the electric motor 72 (cam member 73) to the cam follower 65 that moves in the up-down direction together with the front end portion 45F of the steering roller 45 is upward. In contrast, a direction MD in which the cam follower 65 (the front end portion 45F of the steering roller 45) moves due to gravity acting on the flywheel 55 is downward. That is, the direction DF of the driving force is opposite to the direction MD. Thus, also with the image forming apparatus 10 according to the modification, the driving force required to be generated by the electric motor 72 (driving mechanism 70) in order to change the angle of the rotation axis 45X of the steering roller 45 provided with the flywheel 55 with respect to the width direction of the transfer belt 52 may be made smaller than that in the case where the direction DF and the direction MD are the same.

Although not illustrated, a flywheel 55 may be fixed to a rear end portion of a steering roller 45, and a driven mechanism 60 and a driving mechanism 70 may be provided in the vicinity of a rear edge portion of a transfer belt 52. Further, in this case, a rotation center shaft 45AX is provided in the vicinity of a front end portion 45F of the steering roller 45. Further, in this case, a cam member 73 is located directly below a cam follower 65. Further, a direction DF of a driving force applied by an electric motor (cam member 73) to the cam follower 65 that moves in the up-down direction together with the rear end portion of the steering roller 45 is upward. In contrast, a direction MD in which the cam follower 65 (the rear end portion of the steering roller 45) moves due to gravity acting on the flywheel 55 is downward. Also with the image forming apparatus 10 according to the modification, the driving force required to be generated by the electric motor 72 (driving mechanism 70) in order to change the angle of the rotation axis 45X of the steering roller 45 provided with the flywheel 55 with respect to the width direction of the transfer belt 52 may be made smaller than that in the case where the direction DF and the direction MD are the same.

The cam follower (applied portion) 65 may be fixed to the steering roller 45.

The driving mechanism may have an aspect different from the above-described exemplary embodiment and modification. For example, the driving mechanism may be a mechanism including an electric motor and a moving member that advances and retracts along a rotation output shaft of the electric motor and applies a force to an applied portion. In this case, the direction DF of the driving force applied to the applied portion by the moving member and the direction MD in which the applied portion moves due to gravity acting on the flywheel 55 are opposite to each other.

The image forming apparatus 10 may be configured such that each of the first photoreceptor units 20 and each of the second photoreceptor units 30 form toner images on recording paper P (image carrier body) transported by a transport belt (not illustrated) provided instead of the transfer belt 52. In this case, the transfer belt that transports the images via the recording paper P is an example of the image carrier body.

In the present exemplary embodiment, a toner image is described as an example of an image. In this case, the toner image is formed by a dry electrophotographic system; however, the present disclosure is not limited to this. For example, an image of the present disclosure may be a toner image formed by a wet electrophotographic system or an image formed by an inkjet system.

Further, the image forming apparatus 10 may be configured such that an ink image or a toner image is formed on an elongated non-annular continuous paper (image carrier body) that is wound around multiple rotating bodies including the driving roller 44 and that is transported by the driving roller 44 and the rotating bodies while having a shape having at least one straight portion when viewed in the Z direction, and such that the steering roller (change roller) 45 is rotatably in contact with the inner peripheral surface of the continuous paper.

The number of colors of images (toner images or ink images) formed on an image carrier body (transfer belt 52 or recording paper P) need not be four. For example, the number of colors of images may be six.

For example, three or more image forming units may be arranged along the upper portion 52A. Similarly, three or more image forming units may be arranged along the lower portion 52B.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier body to be transported;

an image forming unit that forms an image on the image carrier body;

a change roller that is in contact with an inner peripheral surface of the image carrier body so as to be rotatable around a rotation axis and that is capable of changing an angle of the rotation axis with respect to a width direction of the image carrier body;

a flywheel provided at the change roller; and a driving mechanism that applies a driving force for changing an angle of the rotation axis with respect to the width direction to an applied portion that moves together with the change roller, wherein a direction of the driving force applied to the applied portion by the driving mechanism is opposite to a direction in which the applied portion moves due to gravity acting on the flywheel.

2. The image forming apparatus according to claim 1, comprising:

a housing that houses the image carrier body, the image forming unit, the change roller, the applied portion, the flywheel, and the driving mechanism, and has an opening provided in a front surface of the housing, the opening being opened and closed by an opening/closing member, wherein the flywheel is provided at a front end portion of the change roller that is movable in a front-rear direction relative to the image carrier body, the image forming unit, and the driving mechanism.

3. The image forming apparatus according to claim 2, wherein the driving mechanism applies the driving force to the applied portion that moves together with a rear end portion of the change roller, and wherein the change roller is rotatable around a rotation center shaft intersecting with the rotation axis.

4. The image forming apparatus according to claim 3, wherein the driving mechanism includes:

an electric motor having a rotation output shaft; and a cam member fixed to the rotation output shaft, and wherein the applied portion is a cam follower with which the cam member is in rotatably contact.

5. The image forming apparatus according to claim 4, wherein the flywheel is provided at one end portion in a longitudinal direction of the change roller, wherein the cam follower is located closer to the other end portion in the longitudinal direction than an intermediate portion in the longitudinal direction of the change roller, and wherein a direction of the driving force applied to the cam follower by the cam member is opposite to a direction in which the cam follower moves due to the gravity acting on the flywheel.

6. The image forming apparatus according to claim 2, wherein the driving mechanism includes:

an electric motor having a rotation output shaft; and a cam member fixed to the rotation output shaft, and wherein the applied portion is a cam follower with which the cam member is in rotatably contact.

7. The image forming apparatus according to claim 6, wherein the change roller is rotatable around a rotation center shaft provided so as to intersect with the rotation axis, wherein the flywheel is provided at one end portion in a longitudinal direction of the change roller, wherein the cam follower is located closer to the other end portion in the longitudinal direction than an intermediate portion in the longitudinal direction of the change roller, and wherein a direction of the driving force applied to the cam follower by the cam member is opposite to a direction in which the cam follower moves due to the gravity acting on the flywheel.

8. The image forming apparatus according to claim 1, wherein the driving mechanism includes:

an electric motor having a rotation output shaft; and a cam member fixed to the rotation output shaft, and wherein the applied portion is a cam follower with which the cam member is in rotatably contact.

9. The image forming apparatus according to claim 8, wherein the change roller is rotatable around a rotation center shaft provided so as to intersect with the rotation axis, wherein the flywheel is provided at one end portion in a longitudinal direction of the change roller, wherein the cam follower is located closer to the other end portion in the longitudinal direction than an intermediate portion in the longitudinal direction of the change roller, and wherein a direction of the driving force applied to the cam follower by the cam member is opposite to a direction in which the cam follower moves due to the gravity acting on the flywheel.

* * * * *